US006905061B2

(12) United States Patent
Song

(10) Patent No.: US 6,905,061 B2
(45) Date of Patent: Jun. 14, 2005

(54) METHOD OF MAKING A GOLF CLUB HEAD

(76) Inventor: Yuan-Lin Song, No. 288 Qing Da Road, He Qing Industrial District, Pudong New Area, Shanghai (CN), 201201

( * ) Notice: Subject to any disclaimer, the term of this patent is extended or adjusted under 35 U.S.C. 154(b) by 0 days.

(21) Appl. No.: 10/672,463

(22) Filed: Sep. 25, 2003

(65) Prior Publication Data

US 2005/0023329 A1 Feb. 3, 2005

(30) Foreign Application Priority Data

Jul. 30, 2003 (CN) ..... 03141933 A

(51) Int. Cl.[7] ..... B23K 31/02; B23K 13/01

(52) U.S. Cl. ..... 228/115; 228/233.1; 228/262.71; 219/617

(58) Field of Search ..... 228/115, 233.1–235, 228/262.71; 219/602–603, 615–617

(56) References Cited

U.S. PATENT DOCUMENTS

| | | | | | |
|---|---|---|---|---|---|
| 2,891,138 | A | * | 6/1959 | Letters, Jr. | 219/616 |
| 5,232,224 | A | * | 8/1993 | Zeider | 473/345 |
| 5,485,998 | A | * | 1/1996 | Kobayashi | 473/345 |
| 5,769,735 | A | * | 6/1998 | Hosokawa | 473/332 |
| 5,913,709 | A | * | 6/1999 | Cyr et al. | 446/418 |
| 6,079,612 | A | * | 6/2000 | Tung | 228/219 |
| 6,162,130 | A | * | 12/2000 | Masumoto et al. | 473/324 |
| 6,617,537 | B1 | * | 9/2003 | Chiu et al. | 219/121.14 |
| 6,699,583 | B1 | * | 3/2004 | Matsuo | 428/375 |
| 2002/0019266 | A1 | * | 2/2002 | Yabu | 473/345 |
| 2002/0187849 | A1 | * | 12/2002 | Kusumoto et al. | 473/305 |
| 2003/0050134 | A1 | * | 3/2003 | Iwata | 473/349 |
| 2003/0119603 | A1 | * | 6/2003 | Yabu | 473/345 |
| 2004/0034986 | A1 | * | 2/2004 | Cheng et al. | 29/525.01 |
| 2004/0082405 | A1 | * | 4/2004 | Sano | 473/342 |
| 2004/0138001 | A1 | * | 7/2004 | Sano | 473/324 |
| 2004/0138002 | A1 | * | 7/2004 | Murray | 473/327 |

FOREIGN PATENT DOCUMENTS

| | | | |
|---|---|---|---|
| JP | 08019626 | * | 1/1996 |

* cited by examiner

*Primary Examiner*—Kiley S. Stoner
(74) *Attorney, Agent, or Firm*—Clement Cheng

(57) ABSTRACT

A method of making a titanium golf club head includes steps. One adopts Ti-4-6 Titanium alloy as SPDF material under isothermal forging conditions, sets the SPDF temperature at between 870–970 degrees Celsius, while heating the molds and workpieces simultaneously in a high frequency stove. One also moves the molds and workpieces from the stove to the forging machine, adjusting the forging machine reacting speed rate within the range of $10^{-2}$/s to $10^{-4}$/s.

8 Claims, 4 Drawing Sheets

METHOD OF MAKING A GOLF CLUB HEAD

TECHNOLOGY FIELD

The present invention relates to a method of making a Titanium golf club head.

BACKGROUND OF INVENTION

The making of a club head includes the making of four parts: a striking face, a sole, a crown, and a shaft. A popular method of forging is to use well distributed Titanium or Titanium alloy material, cut into semi-finished metal by a processing mold, heat semi-finished metal, then pressed to finished shape by a finish-mold. There are some defects existing in current technology. The formed striking face, sole and crown portion have the same thickness on all its sections. Such portions may not have different thicknesses no matter the pressure.

Also, the ductility of Titanium material is not as good as its intensity. Titanium material often splits on the club head when formed. The split cannot be solved particularly when forming more complicated or more deformed sole portion. After the club head is formed, pressure increases and causes serious deformation. Thus, the external appearance of club sole and crown, and the radius of the horizontal and vertical section cannot be controlled.

OBJECTS AND ADVANTAGES

The present invention solves the technology problem that causes defects in making the Titanium club head by the traditional method, disclosing a new method of SPD formation to make Club Head. The SPD formation breaks through the limitations of the traditional method being unable to form a more complicated shape and different thickness of sections. The new Club Head greatly enhances the function of striking and the exterior appearance.

The present invention addresses the unitary thickness and split problems on traditional made Titanium Club Head with high intensity but poor ductility. The present invention allows the forming of complicated shape and striking face with various thicknesses without precise forging methods. Meanwhile forming a club sole with various thicknesses changes the weight distribution of the Club Head, so as to lower the center of gravity of the Club.

Secondly the present invention fulfills the continuous demands on exterior designs of Club Head in the market. Thirdly the application of high intensity Titanium and its alloy material in the present invention allows the making of bigger and securer Club Head. Since the sole and the crown of the Club Head in present invention are weld by SPD formation without inner pressure, the horizontal and vertical curved radius of striking face changes briefly.

DETAILED DESCRIPTION OF PREFERRED EMBODIMENT

The method of making the improved Club Head requires assembling the semi-finished parts of the club face 130, sole 120, crown 100, and shaft parts together, then forming the exterior surface to fit the commercial requirements. The formation of such parts is not by heated forging, or precise forging, or CNC computer controlled precise mechanical process, but by super plastic deformation SPD or severe plastic deformation. Such SPD formation includes patterns and workpieces for isothermal forging after heating.

The method of SPD formation can form extremely complicated club head parts like the striking face, sole, and crown. The striking face of club head made by such method may demonstrate its different thickness form, such as a thicker middle portion than side toe and heel portions, or comparatively thinner of middle portion than side toe and heel portions. The adjustment of sectional thickness and structure of the striking face enhances the bouncing rate and the striking distance of the club.

Figure 1:
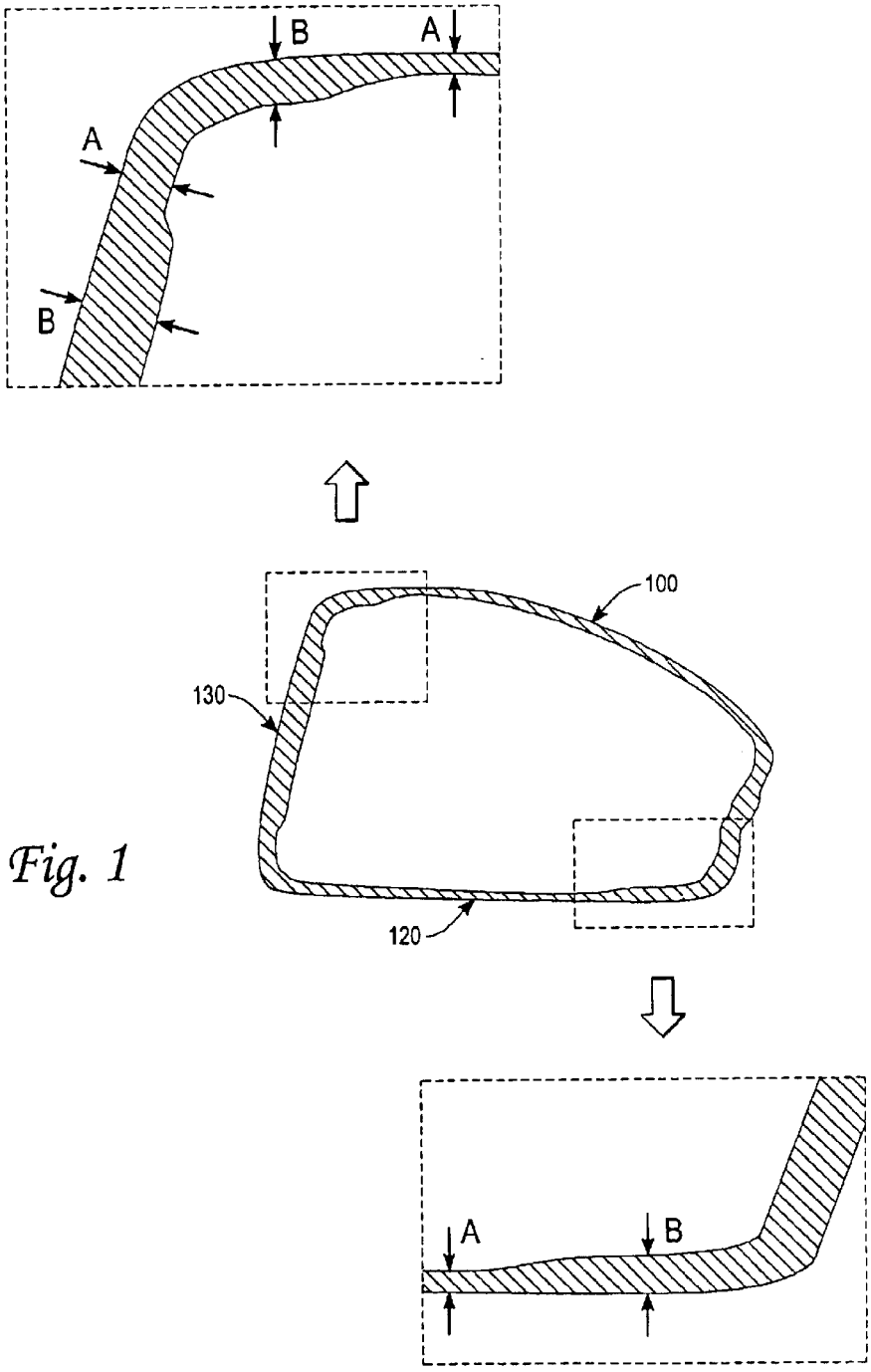
FIG. 1 is a sectional view of present invention, showing striking face, sole, and crown

The material adopted in the club striking face is Ti-6-4 Titanium alloy. FIG. 1 shows the sectional view striking face, sole, and crown after SPD formation. The thickest portion of the striking face 1 on FIG. 1 is 4.0 mm, while the thinnest portion is 1.8 mm. FIGS. 2, 4, 6, 8 show different embodiments having various thicknesses on the striking face. The methods of making present invention comprises following steps:

1. Adopting Ti-4-6 Titanium alloy as SPD material under isothermal forging method.
2. Putting the semi-finished parts into a finish mold
3. Setting SPD temperature as 920 degrees Celsius, while heating the molds and semi-finished parts simultaneously in a high frequency sonic stove. Then removing these from the stove to a forging machine such as the SY-2 to forge the molds and semi-finished parts isothermally. The SY-2 or other forging machines required can be found widely on the market.
4. Adjusting the reacting speed rate within the range from $10^{-2}$ s to $10^{-4}$ s, (0.1 seconds to 0.001 seconds). Adopting a lower time for larger quantity. The preset range of temperature and reacting speed are designated to Ti-6-6 Titanium Alloy only as shown in the first embodiment. If different material is used, other sets of temperature and reacting speed shall be differed.

In the second and alternate embodiment the material adopted in sole and crown is also Ti-6-4 Titanium Alloy. The methods of making are basically the same as the methods in the first embodiment but the thicknesses vary at portion A and portion B on club sole 3 on FIG. 1. A portion on FIG. 1 is as thin as 1.0 mm while the connection portion between A and B is slightly thicker. The thickness in B portion is 1.3 mm. The section of crown portion 2 in FIG. 2 is comparatively even.

Figure 2:
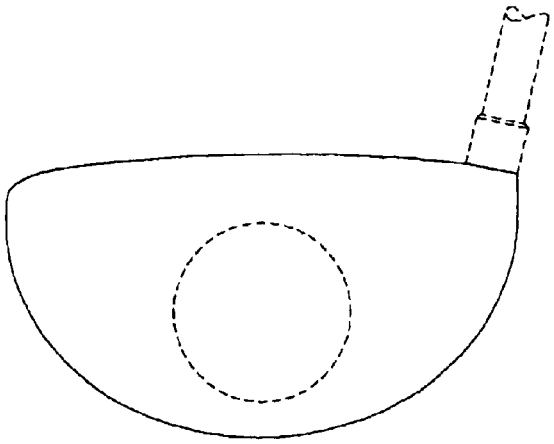
FIG. 2 is a front view of the front striking face of first embodiment
Figure 3:
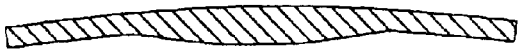
FIG. 3 is a sectional view of the front striking face of first embodiment

The various forms of striking faces capable of being made can be seen in FIG. 2 to FIG. 9. FIG. 2–3 shows a protrusion.

Figure 4:
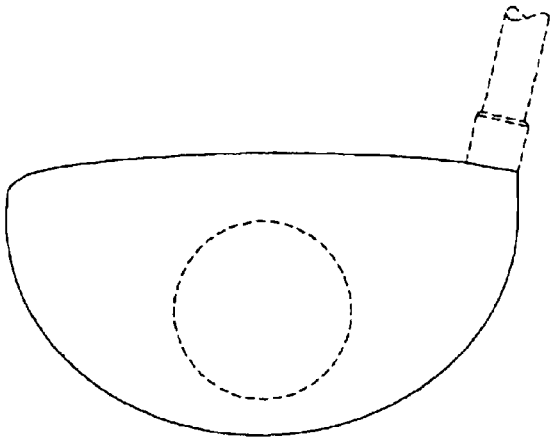
FIG. 4 is a front view of the front striking face of second embodiment
Figure 5:
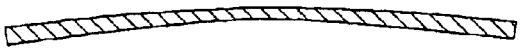
FIG. 5 is a sectional view of the front striking face of second embodiment.
Figure 6:
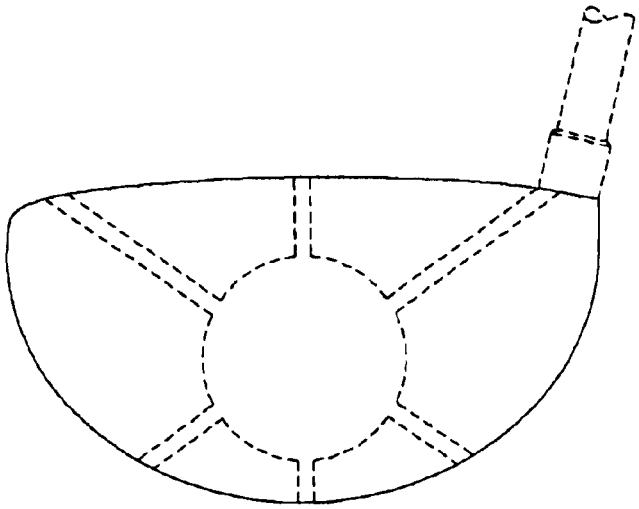
FIG. 6 is front view of the front striking face of third embodiment
Figure 7:
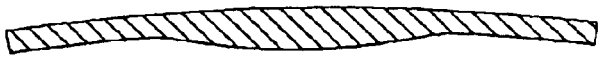
FIG. 7 is a sectional view of the front striking face of third embodiment
Figure 9:
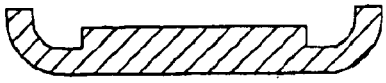
FIG. 9 is a sectional view of the front striking face of forth embodiment
Figure 8:
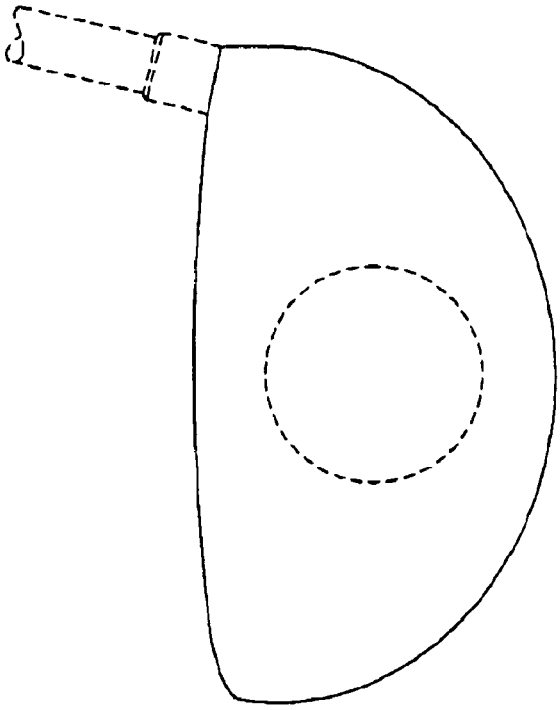
FIG. 8 is front view of the front striking face of forth embodiment

FIGS. 4–5 show a depression of the striking face. The other figures show other shapes available.

What is claimed is:

1. A method of making a titanium golf club head comprising the steps of:

a. putting a semi-finished club head into a mold, the semi-finished club head comprising the parts of: a striking face, sole, crown, and shaft;

b. molding the parts together in a sonic stove;

c. forging the parts in a forging machine;

d. processing the surface of the club head.

2. The method in claim 1 wherein the forging temperature is 920 degrees Celsius when using Ti-6Al-4V as forging material.

3. The method in claim 1 wherein reacting speed of the titanium golf club head is in the range from 0.1 s to 0.001 s.

4. A method of making a titanium golf club head comprising the steps of:

a. adopting Titanium alloy as SPDF material under isothermal forging conditions, b. puffing semi-finished workpieces including a striking face, sole, crown, and shaft into a mold, c. setting the SPDF temperature at between 870–970 degrees Celsius, while heating the mold and workpieces simultaneously in a high frequency stove, d. moving the mold and workpieces from the stove to the forging machine, e. adjusting the forging machine reacting speed rate within the range of $10^{-2}$/s to $10^{-4}$/s.

5. The method of claim 4 wherein the thickness of the club sole varies from 1.0 mm to 1.3 mm, wherein the crown section has relatively uniform thickness.

6. The method in claim 4 wherein the forging temperature is about 920 degrees Celsius when using Ti-6Al-4V as forging material.

7. The method in claim 4 wherein the reacting speed is in the range from 0.2 s to 0.002 s.

8. The method in claim 4 wherein the titanium is Ti-6Al-4V.

* * * * *